US007353972B2

(12) United States Patent
Nehren

(10) Patent No.: US 7,353,972 B2
(45) Date of Patent: Apr. 8, 2008

(54) SEALING PISTON FOR CARTRIDGES WITH DE-AERATION AND BARRIER PROPERTIES

(75) Inventor: Klaus-Dieter Nehren, Dormagen (DE)

(73) Assignee: Heraues Kulzer GmbH & Co. KG, Hanau (DE)

( * ) Notice: Subject to any disclaimer, the term of this patent is extended or adjusted under 35 U.S.C. 154(b) by 39 days.

(21) Appl. No.: 10/932,862

(22) Filed: Sep. 2, 2004

(65) Prior Publication Data

US 2005/0087565 A1 Apr. 28, 2005

(30) Foreign Application Priority Data

Sep. 10, 2003 (DE) ..... 103 42 090

(51) Int. Cl.
*B67D 5/52* (2006.01)

(52) U.S. Cl. ..... 222/386; 222/325; 222/137

(58) Field of Classification Search ..... 222/137, 222/145.5, 145.6, 386, 325–327, 387, 401, 222/402, 390, 391
See application file for complete search history.

(56) References Cited

U.S. PATENT DOCUMENTS

| | | | | |
|---|---|---|---|---|
| 3,028,052 | A * | 4/1962 | Archer | 222/136 |
| 4,452,370 | A | 6/1984 | Langensiepen et al. | |
| 4,645,098 | A | 2/1987 | Hoffmann | 222/386 |
| 4,834,268 | A | 5/1989 | Keller | 222/327 |
| 4,951,848 | A | 8/1990 | Keller | 222/386 |
| 5,150,823 | A * | 9/1992 | Sugita | 222/386 |
| 5,178,305 | A | 1/1993 | Keller | 222/386 |
| 5,295,615 | A * | 3/1994 | Gentile | 222/327 |
| 5,400,926 | A | 3/1995 | Keller | 222/327 |

FOREIGN PATENT DOCUMENTS

| | | |
|---|---|---|
| DE | 23 02 364 | 9/1974 |
| DE | 34 05 547 | 8/1985 |
| DE | 34 35 576 A1 | 4/1986 |
| DE | 87 10 233 | 12/1987 |
| DE | 36 35 849 C2 | 4/1988 |
| DE | 42 29 588 C2 | 3/1994 |
| DE | 196 43 506 A1 | 4/1998 |
| DE | 100 29 799 A1 | 12/2001 |
| EP | 0 152 373 | 8/1985 |
| EP | 0 281 755 | 9/1988 |
| EP | 0 301 327 | 2/1989 |
| EP | 0 344 491 B1 | 12/1989 |
| EP | 0 463 991 B1 | 1/1992 |
| EP | 0 497 739 B1 | 8/1992 |
| EP | 1 209 098 A1 | 5/2002 |
| WO | WO 90/05096 | 5/1990 |
| WO | WO 95/09785 | 4/1995 |

* cited by examiner

*Primary Examiner*—J. Casimer Jacyna
(74) *Attorney, Agent, or Firm*—Norris McLaughlin & Marcus, PA

(57) ABSTRACT

A cylindrical cartridge for receiving a pasty material, having a sealing piston and a spreading piston insertable into the sealing piston which, sealing piston and spreading piston, when inserted into said cartridge, cooperate to vent air from and seal said cartridge.

4 Claims, 2 Drawing Sheets

SEALING PISTON FOR CARTRIDGES WITH DE-AERATION AND BARRIER PROPERTIES

BACKGROUND OF THE INVENTION

The invention relates to cartridges for receiving pasty materials. The use of cartridges is customary today in very many product groups. In addition to single-component and multi-component adhesive and sealing substances as well as printing inks, dental molding masses are also offered in plastic and aluminum cartridges. Many of these products are damaged on storage in the cartridge or have only short service lifetime due to air bubbles that are introduced, or diffusion through the packaging material.

The air bubbles arise in the cartridge when the piston is inserted into the cartridge opening after filling. Since the pistons must have a function of sealing to the cartridge wall, the air cushion located between the product and piston is at least partially enclosed. In the case of moisture-sensitive products, hardening can occur at the edges of incursions of air.

In the case of products containing filling substances it is a known problem that, at pastes' boundary surfaces with the air, settling of liquid components occur that can interfere with the use of these pastes.

In particular, in the case of multi-component products for automatic mixing systems with static or dynamic mixers, air bubbles lead, in most double cartridges, to varying mixture ratios since the air bubbles under the feed pressure increasing at the beginning are first compressed and delay the application of the product. This then leads at the end, with subsiding feed pressure, to re-squeezing of the bubble-containing component. Particularly in the case of pastes fed by hand through lever function, a constantly varying mixing ratio results thereby. However, this interference also occurs in all the other hand-driven, pressure-driven, or motor-driven manual or floor-mounted devices.

An additional problem for several products is the leakage of constituents or the penetration of moisture or other components of the air.

While in cartridge bodies, sufficient barrier properties can be achieved by the use of, for example, aluminum or increased wall thicknesses in plastics, the plastic pistons frequently form the weakest point of the cartridge.

There have been many attempts to provide cartridges having good barrier properties and de-aeration at the same time.

DE 100 29 799 A1 relates to a cartridge piston in which the piston shoulder pressed due to the conveyance pressure of the application unit onto a spreading ring pointed into the piston in such a manner that it seals at the wall of the cartridge. DE 42 29 588 A1 describes a cartridge piston with elastic piston base and a final protuberance whose outer diameter is greater than the inner diameter of the cartridge. In EP 0 301 327 B1 (DE 8710233 U1) a cartridge piston is described in which the piston shoulder presses on the wall of the cartridge in such a manner that a seal is formed by a reinforcing ring that can be pushed in so that it clamps on a spreading ring pointed into the piston. DE 34 05 547 (EP 0 152 373) discloses a piston with an annular groove running obliquely to the wall of the cartridge into which an elastic sealing ring is admitted. DE 34 35 576 deals with a follower piston for dispensers with a de-aeration opening that can be sealed. DE 36 35 849 A1 describes a piston that can be de-aerated for dispensers with a pointed connecting piece. In WO 90/05096 a de-aeratable piston with self-securing stoppers is presented. DE 23 02 364 A1 has as its object a de-aeratable piston for cartridges with a pointed sealing stopper contained in the de-aeration channel sitting in the middle. EP 1 209 098 A1 relates to a cartridge with pistons for the processing of tubular bags in customary application pistols. In EP 281 755 B1 (U.S. Pat. No. 4 ,834,268) the piston has an annular groove into which an elastic sealing ring is admitted. EP 344 491 B1 describes cartridges with a piston that has a sealing ring and radial de-aeration channels leading to a de-aeration hole to be sealed by means of a screw. EP 463 991 B1 relates to cartridges with a piston that have a sealing ring and radial de-aeration channels leading to a de-aeration hole with stoppers. EP 497 739 B1 (similar to U.S. Pat. No. 5,400,926) recommends cartridges with a piston that has a sealing ring and radial de-aeration channels leading to a de-aeration hole with stoppers where, in front of the sealing ring, sealing lips are still disposed whose encircling groove empties into the de-aeration channels. In DE 196 43 506 A1, the piston of an application unit is structured as two parts for the pressure load after the conveyance. DE 197 14 331 A1 describes a cartridge piston that has channels or grooves running in the radial direction between a central de-aeration hole and the edge of the piston.

In each of EP 344 491, EP 463 991, EP 497 739, U.S. Pat. No. 5,400,926, DE 197 14 331, and WO 90/05096 pistons for cartridges or dispensers are mentioned, each of which ensures the de-aeration by a channel contained in the center of the piston. The channel is then sealed in an additional second step with a separate part 1 in the form of screws or stoppers. Thereby, the length of the cycle in filling is clearly increased.

This disadvantage of the increased expenditure in filling can be eliminated, as described in DE 23 02 364 A1 and DE 36 35 849 A1, by the necessary stoppers already being a part of the piston and only having to seal the de-aeration channel by pressing in after the aeration.

Another way is described in DE 100 29 799 A1 by, on the base of the piston, the sealing edge facing the product being so small that the air can escape during insertion of the piston. In order to have the necessary sealing action during application of the product under high pressure, the piston contains in its interior a spreading ring that causes an extension of the base of the piston up to the wall of the cartridge due to the pressure of the applicator piston.

In EP 301 327 A2, the principle of the spreading ring is used, but the extension is not only caused by the applicator but rather, in a second processing step, a reinforcing ring is pushed in there in such a manner that it clamps onto the spreading ring, which provides for an immediate and long-lasting extension of the base of the piston.

A piston with an elastic base whose rear edge abuts the edge of the cartridge due to its greater diameter is mentioned in DE 42 29 588 A1.

The realizations of the state of the art still leave something to be desired with regard to de-aerability, barrier properties, and the simplicity of processing and filling.

It is thus the objective of the invention to provide cartridges that can be processed during filling without incursions of air, permit as simple and quick a filling as possible, offer good barrier properties against moisture, and have high mechanical strength in order not to deform under conveyance pressure.

By a special development of the piston and, in given cases, a special combination of various materials being used, all these required properties can be implemented and can be adapted to specific requirements.

SUMMARY OF THE INVENTION

The invention thus relates to a cartridge that is intended to receive pasty materials, has a cylindrical cartridge body, and has a two or more part piston comprising a sealing piston and a spreading piston that can be introduced into a cavity therein, where (a) the sealing piston has a somewhat smaller outer dimensions than the inner wall of the cartridge so that it abuts essentially in such a manner that it can slide but still unseals de-aeration openings, and (b) the spreading piston has, at least at several points, greater dimensions than the cavity provided for it in the sealing piston can accommodate.

Thereby, after guiding of the spreading piston into the sealing piston, the de-aeration openings are closed by radial deformation of the sealing piston outwards. The cartridge can also be formed as a double or multiple cartridge.

The principal feature of the piston is its two-part form of sealing and spreading piston with de-aeration holes that can be sealed by the spreading piston. The spreading piston is essentially elastically deformable, or its material yields. For example, a relatively thin-walled sealing piston of elastic or plastic material such as PE-LD, PE-HD, PP, or TPE or waste as plastic injection molding is simple to produce and economical. However, PTFE or various varieties of rubber are also suitable that, however, cannot be processed by means of injection molding and thus are more expensive in their production. Along with this, the choice of material can be limited as a consequence of incompatibility with the product.

In order to master the high forces that can occur during the application of the products, it is reasonable to provide a separate spreading piston from a less flexible and clearly harder material. The spreading piston is essentially rigid. Therein, a material with the needed mechanical strength and barrier action can be chosen from, e. g. PP, PE-HD, PA, POM, for the injection molding technique. The use of metals such as aluminum or steel is conceivable but expensive.

The spreading piston exerts forces in the radial direction outwards, said forces pressing the sealing piston more strongly onto the cylindrical inner wall of the cartridge. That is, for example, to be realized from the standpoint of construction by it being possible to press the spreading piston into the sealing piston and at several points having greater dimensions than the corresponding cavity of the sealing piston can accommodate. That causes forces directed in the outward direction. The insertion of the spreading piston into the sealing piston so that a firm connection arises is preferred. This is to be realized simply by catch means.

Air pressure arising during the pressing in or insertion process is, in given cases, to be discharged through openings in the spreading piston. The air pressure can, however, also be used to increase the pressure forces on the cavity of the sealing piston. The sealing piston is advantageously already implemented so that it is essentially in sliding connection with the cylinder wall, but still unseals de-aeration openings, usually in an annular form along the cylinder wall. These de-aeration openings are closed after the pressing in of the spreading piston. It is advantageous when the sealing piston is implemented on the side turned toward the filling goods so as to be convex or conical. Thereby, the air expelled in filling is conducted to the de-aeration openings.

A form of embodiment of the invention is explained in more detail with the aid of drawings:

BRIEF DESCRIPTION OF THE DRAWINGS

FIG. 3 shows the individual parts of sealing and spreading piston before the pressing in.

Figure 2:
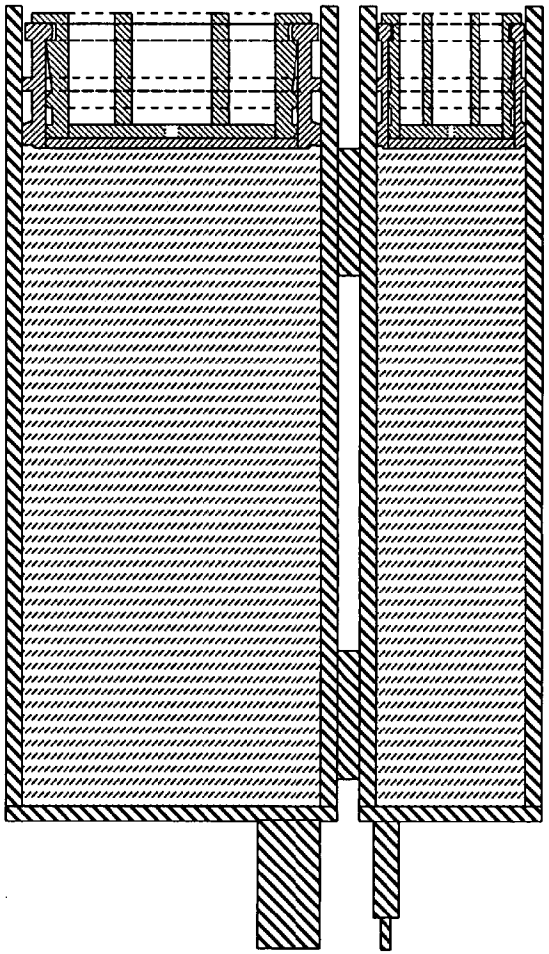
FIG. 2 shows the situation after the pressing in of the spreading piston.
Figure 1:
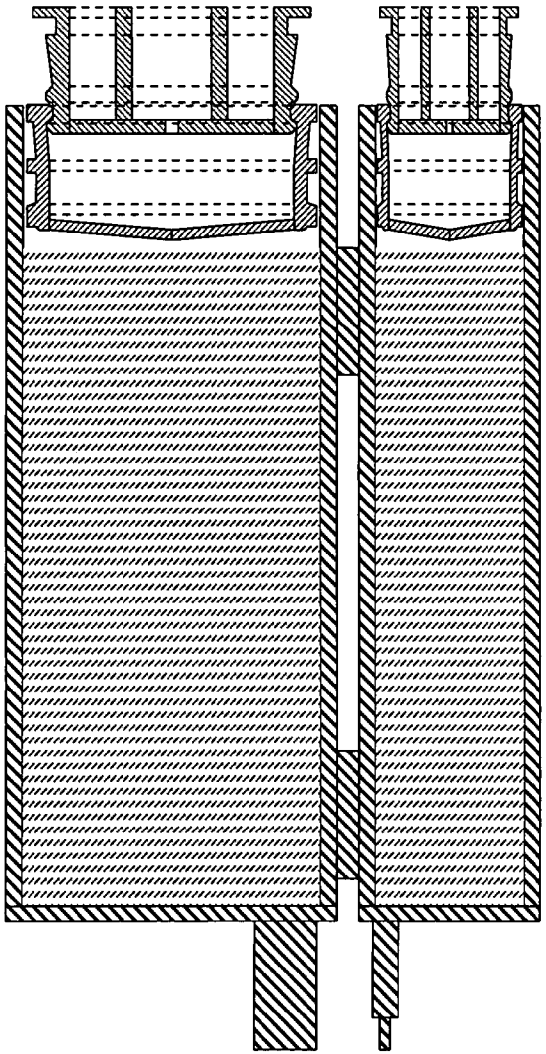
FIG. 1 shows a double cartridge with two pistons consisting of sealing and spreading pistons before pressing in the spreading piston.
Figure 4:
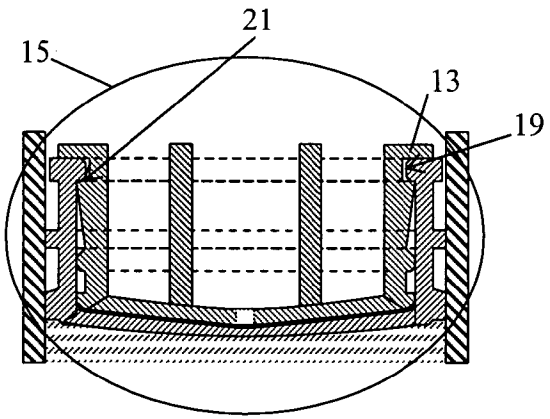
FIG. 4 shows the situation after the pressing in of the spreading piston.
Figure 5:
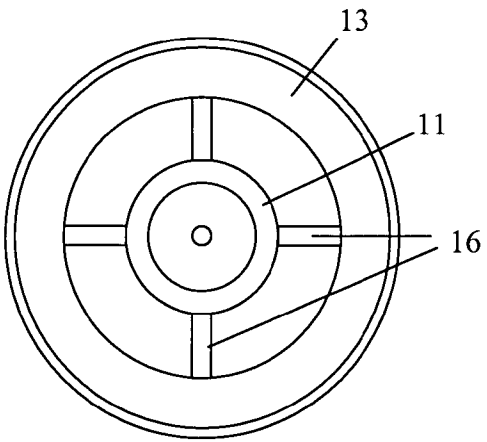
FIG. 5 shows a plan view to represent the rings 11 and the braces 16.
Figure 3:
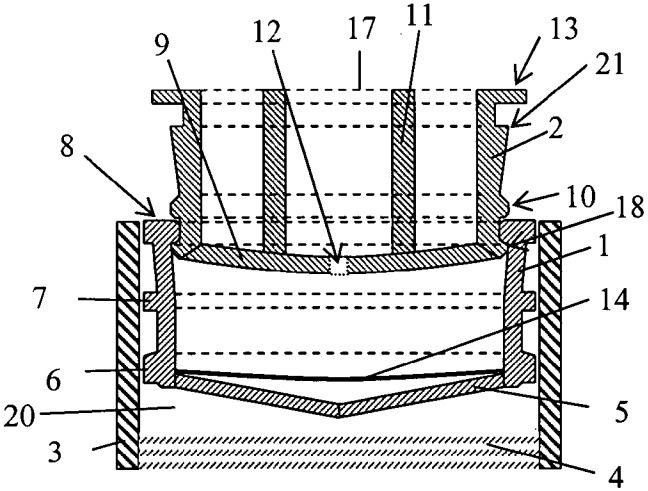

The sealing piston 1 is, from the rear, concave, has several encircling rings 6, 7, 8 for sealing and wiping off of the product 4, and is at all points negligibly smaller in diameter than the inner diameter of the cartridge tube 3.

The spreading piston 2 is advantageously formed so that it is insertable into the sealing piston 1 and abuts an encircling, as much as possible, protuberance 10 on the upper edge 8 of the sealing piston, in order to penetrate only a little into the sealing piston, but until the insertion into the cartridge to be held by a front protuberance 18 therein.

A small aeration hole 12 is placed in the base 9 of the spreading piston 2 in order to make possible the fitting into one another of the pistons 1 and 2. In order to receive the pressure of the entire piston 15, a combination of 1 with 2 and 14, as uniformly as possible, the spreading piston 2 can have rings 11 and/or braces 16 running in the radial direction in the cavity that can reach from the base 9 to the edge 17.

At the upper edge 17, it has a protuberance 13 that projects over the inner edge 19 of the sealing piston 1, but does not reach to the wall 3 of the cartridge.

Sealing and spreading pistons 1+2 are already used in filling in preassembled form, where the expenditure in time and equipment is equivalent to that of a single-part piston.

The sealing piston 1 has a base 5 that is arched or pointed in the direction contacting product in order to produce the contact with the product first in the center of the cartridge tube 3. Since the edge of the base of the piston 6 and all the sealing rings 7/8 following it have a negligibly smaller diameter than the cartridge tube 3 inside, the air 20 still present is expelled by the product 4 on further pushing in. Only when the product 4 fills up the thin gap between the wall 3 of the cartridge and the edge 6 of the base of the piston is the force increased discontinuously in order to push the piston further.

Thereby, the spreading piston 2 is pressed into the sealing piston 1 up to the stop, where the sealing rings 6/7 of the sealing piston widen up to the wall 3 of the cartridge and its base 5 lies due to extension on the base 9 of the spreading piston 2. This position is maintained by the catch means 21.

For particularly sensitive products a barrier foil 14 of, e. g. aluminum or EVOH, can be laid into the sealing piston 1 in the preassembly of the piston combination (1+2). Thereby the barrier properties can be improved still further. The foil is provided on its inner side of the sealing piston and remains after the guiding in and catching of the spreading piston between spreading and sealing pistons.

I claim:

1. Cartridge for receiving a pasty material, comprising a cylindrical cartridge body having an inner wall, a two part piston with a sealing piston and a spreading piston, said sealing piston having an interior cavity for receiving said spreading piston, wherein (a) the sealing piston has a smaller outer dimension than the inner wall of the cartridge body thereby providing a de-aeration opening between the sealing piston and the inner wall of the cartridge body, and the sealing piston includes an upper edge, (b) the spreading piston includes at least one radial lip disposed on an outside of the piston and having a dimension greater than the cavity provided in the sealing piston, causing radial deformation of the sealing piston upon full insertion of the spreading piston, and the spreading piston includes a radial patch disposed on the outside of the spreading piston, and wherein the radial catch is formed to engage with the upper edge of the sealing piston, and wherein the sealing piston includes at least one sealing ring disposed between the inner wall of the cartridge body and the sealing piston.

2. Cartridge according to claim 1, wherein the at least one sealing ring of the sealing piston comprises a plurality of sealing rings between sealing piston and the inner wall of cartridge body.

3. Cartridge according to claim 1, wherein the sealing piston has an outwardly projecting convex or conical base.

4. Cartridge according to claim 1, wherein the spreading piston includes a catch disposed on the outside and wherein the inner side of the sealing piston is provided with a complementary catch surface.

* * * * *